US005950551A

United States Patent [19]

Yoshida et al.

[11] Patent Number: 5,950,551

[45] Date of Patent: Sep. 14, 1999

[54] SEWING MACHINE SYSTEM HAVING DATA EDITING DEVICE

[75] Inventors: Shinji Yoshida, Nagoya; Kazushi Inoue, Aichi-gun; Yoshihiro Hara, Kasugai; Minoru Yamaguchi, Kariya, all of Japan

[73] Assignee: Brother Kogyo Kabushiki Kaisha, Aichi-ken, Japan

[21] Appl. No.: 09/085,564

[22] Filed: May 27, 1998

[30] Foreign Application Priority Data

May 27, 1997 [JP] Japan ..... 9-136878

[51] Int. Cl.[6] ..... D05B 21/00; D05C 5/06

[52] U.S. Cl. ..... 112/102.5; 112/470.04; 112/445; 364/470.09

[58] Field of Search ..... 112/470.01, 102.5, 112/470.04, 470.06, 456, 457, 458, 445, 475.19; 364/470.07, 470.09

[56] References Cited

U.S. PATENT DOCUMENTS 4,960,061 10/1990 Tajima et al. .

5,255,620 10/1993 Sasano et al. ..... 112/445 X 5,343,401 8/1994 Goldberg et al. ..... 112/475.19 X 5,392,724 2/1995 Kurono et al. ..... 112/103 X 5,427,044 6/1995 Hirabayashi ..... 112/457 X 5,775,240 7/1998 Hara et al. ..... 112/102.5

*Primary Examiner*—Peter Nerbun

*Attorney, Agent, or Firm*—Kane, Dalsimer, Sullivan, Kurucz, Levy, Eisele and Richard, LLP

[57] ABSTRACT

Disclosed is a sewing machine system, including an electronically controlled sewing machine, and a data editing device. In a sewing machine, a plurality of sewing programs stored in a data recording medium are read, and image data indicative of a sewing pattern corresponding to each sewing program is generated. The image data is then transmitted to the data editing device. In the data editing device, a plurality of sewing patterns are displayed in accordance with the received image data. When one of the displayed sewing patterns is selected by an operator, a predetermined operation is applied to a sewing program corresponding to the selected sewing pattern.

19 Claims, 11 Drawing Sheets

SEWING MACHINE SYSTEM HAVING DATA EDITING DEVICE

BACKGROUND OF THE INVENTION

The present invention relates to a sewing machine system provided with a data editing device.

Conventionally, electronically controlled sewing machines which automatically perform sewing operations have been known. During the automatic sewing operation, a cloth feeding mechanism, sewing needle and the like are driven by a controller in accordance with sewing programs, and a sewing pattern may be formed on a cloth automatically. Among sewing machine systems employing such an electronically controlled sewing machine, there are ones which are implemented with a data editing function for editing a sewing program.

When a sewing program is to be created with use of such an electronically controlled sewing machine, an operator is to input data including a type of stitch (e.g., a line stitch, a curved stitch, a zigzag stitch, or the like), stitching points (e.g., a stitch start point, a stitch end point, and/or intermediate points), a pitch of stitches, various conditional parameters for determining a sewing path from the stitch start point to the stitch end point. Then, a program used for automatically performing the sewing operation is generated based on the input data, and stored in a memory of the electronically controlled sewing machine system.

Such an electronically controlled sewing machine system may be generally provided with a data storage device such as a flexible disk drive, and the program thus generated may be stored in a data recording medium such as a flexible disk as a data file. To such a data file, a number intrinsic thereto may be assigned as an identifier of the file. A plurality of sewing data files respectively having different identifying numbers may be stored in the data recording medium. When one of the sewing data files is to be referred to (e.g., to be deleted, or to be modified), the operator is to designate one of the sewing data files stored in the data recording medium by the identifying number. Then, the designated data file becomes accessible, and therefore, deleting or editing thereof becomes possible.

In the electronically controlled sewing machine described above, if the operator does not remember the identifier (i.e., the identification number) of the program file to be referred to, it is difficult to find the file of intent. It may become necessary to load each program and execute the sewing operations in accordance with the loaded program until the intended program file is found.

SUMMARY OF THE INVENTION

It is therefore an object of the invention to provide an improved sewing machine having a data editing device. In the improved sewing machine system according to the invention, it is possible to find a sewing data file relatively easily, and edit or delete the same immediately.

For the above object, according to the present invention, there is provided a sewing machine system including an electronically controlled sewing machine, and a programmer for creating a sewing program, and a data recording medium, the sewing program being to be stored in the data recording medium, the electronically controlled sewing machine performing automatic sewing operation in accordance with the sewing program, the sewing machine system comprising: a reading device that reads a plurality of sewing programs stored in the data recording medium; an image data generating device that generates image data indicative of sewing patterns respectively corresponding to the plurality of sewing program read by the reading device; a displaying device that displays the plurality of sewing patterns in accordance with the image data; a selecting device that is manually operated to select one of the sewing patterns displayed on the displaying device; and a sewing program processing device that applies a predetermined operation to a sewing program corresponding to the selected sewing pattern.

Accordingly, on operator of the sewing machine system is capable of visually confirming a pattern which would be formed in accordance with a sewing program, and then process (edit, modify or delete) the sewing program.

Optionally, the sewing program processing device may control the reading device to read the sewing program corresponding to the selected sewing pattern, and the sewing program processing device may include a data editing device that is used for editing the sewing program to modify the program or to create a new sewing program.

Further optionally, the sewing program processing device may further include data storing device that stores the new sewing program in the data recording medium.

Still optionally, the displaying device may have an image display screen having a plurality of image display areas, and the image generating device generates the image data such that an entire image of each of the plurality of sewing patterns is displayed in the plurality of image display areas.

In particular, the image data generating device may determine a magnification ratio of each of the images of the plurality of sewing patterns such that the images of the plurality of sewing patterns become greatest in the plurality of display areas, respectively.

With this configuration, in each display area, the entire image of a pattern is displayed regardless of its original size.

Alternatively or optionally, image generating device may generate the image data such that entire areas of a plurality of portions on which the plurality of sewing patterns would be sewn when the sewing machine system performs an automatic sewing operation in accordance with the plurality of sewing programs are displayed, respectively.

In particular, the image data generating device may determine a magnification ratio of each of the images of the plurality of sewing patterns such that the areas of the plurality of sewing patterns become greatest in the plurality of display areas, respectively.

With this configuration, in each display area, the entire image of the sewing portion is displayed regardless of its original size, and the positional relationship between the sewing portion and the pattern can be visually recognized.

According to another aspect of the invention, there is provided a sewing machine system capable of performing automatic sewing operation in accordance with a sewing program to form a sewing pattern within a predetermined sewing area on a cloth, the sewing machine system being capable of creating a sewing program, the sewing machine system comprising: a displaying device that displays an image of a sewing pattern in accordance with a sewing program; and a data editing device which is used to edit the sewing program corresponding to the sewing pattern displayed on the displaying device.

With this constitution, the operator can visually confirm the pattern represented by a program to be edited, and then, edit the program.

Optionally, the displaying device has a display area having a predetermined size, and the displaying device may include a display controller which automatically adjusts a size of the sewing pattern displayed on the display area, based on the sewing program, such that an entire area of the sewing pattern is displayed within the display area.

In particular, the display controller may adjust the size of the sewing pattern such that the sewing pattern has the largest size within the display area.

Alternatively, the displaying device has a plurality of display areas each having a predetermined size, a plurality of sewing patterns being displayed in respective display areas, and the displaying device may include a display controller which automatically adjusts a size of the plurality of sewing patterns displayed in the display areas, based on the sewing programs, such that an entire area of the sewing patterns are displayed within the display areas, respectively.

In particular, the sewing machine system may further include: a first selector that is manually operable to select one of the plurality of sewing patterns respectively displayed in the plurality of display areas; and a second selector that is manually operated to select whether a sewing program corresponding to a sewing pattern select with use of the first selector is to be edited by the data editing device.

According to a further aspect of the invention, there is provided a sewing machine system capable of creating a sewing program to be used for automatic sewing operation, comprising: an electronically controlled sewing machine, which includes:

a sewing program processing device that reads sewing programs stored in a data recording medium;

an image data generating device that generates image data indicative of a sewing pattern corresponding to a sewing program read by the sewing program processing device; and a first communication device that transmits the image data; and a data editing device, which includes:

a second communication device that receives the image data transmitted from the first communication device;

a displaying device that displays the sewing pattern in accordance with the image data received by the second communication device; and a selector that is manually operated to select the sewing pattern displayed on the displayed device, wherein, the second communication device transmits data related to a selected sewing pattern to the first communication device upon one of the sewing patterns has been selected, and the sewing program processing device applies a predetermined operation to the sewing program corresponding to the selected sewing pattern and stored in the data recording medium.

Optionally, the predetermined operation may include deletion of the sewing program corresponding to the selected sewing pattern from the data recording medium.

Further optionally, the sewing program processing device may read, in accordance with the data related to the selected sewing pattern received by the first communication device, a sewing program corresponding to the selected sewing pattern, and the first communication device may transmit the sewing program corresponding to the selected sewing pattern and read by the sewing program processing device to the second communication device, the sewing program being edited by the data editing device.

In particular, the sewing program edited by the data editing device may be transmitted by the second communication device, received by the first communication device, and stored in the data recording medium by the sewing program processing device.

Still optionally, the data editing device is detachablly connected to the electronically controlled sewing machine.

Further, the sewing machine system may include an operating device that is manually operated when a sewing operation is to be performed, the operating device being provided separately from the data editing device.

According to another aspect of the invention, there is provided a method of processing program files for a sewing machine system capable of creating a sewing program which is used for automatic sewing operation, comprising the steps of: reading a plurality of sewing programs stored in a data recording medium; generating image data indicative of a sewing pattern corresponding to each sewing program read in the step of reading; displaying a plurality of sewing patterns in accordance with the generated image data; selecting one of the displayed sewing patterns; and applying a predetermined operation to a sewing program corresponding to the selected sewing pattern.

Optionally, the step of applying a predetermined operation may include a step of deleting the sewing program.

Further, the step of applying a predetermined operation may include a step of editing the sewing program to create a new sewing program.

Furthermore, the step of applying a predetermined operation further may include a step of storing the new sewing program in the data recording medium.

According to a further aspect of the invention, there is provided a memory for storing a program to be executed by a computer, the program containing a method of processing program files for a sewing machine system capable of creating a sewing program which is used for automatic sewing operation, wherein the method comprises the steps of: reading a plurality of sewing programs stored in a data recording medium; generating image data indicative of a sewing pattern corresponding to each sewing program read in the step of reading; displaying a plurality of sewing patterns in accordance with the generated image data; selecting one of the displayed sewing patterns; and applying a predetermined operation to a sewing program corresponding to the selected sewing pattern.

Optionally, the step of applying a predetermined operation may include a step of deleting the sewing program.

Further, the step of applying a predetermined operation may include a step of editing the sewing program to create a new sewing program.

Furthermore, the step of applying a predetermined operation may include a step of storing the new sewing program in the data recording medium.

DETAILED DESCRIPTIONS OF THE PREFERRED EMBODIMENTS

The invention will be described with reference to the accompanying drawings.

Figure 1:
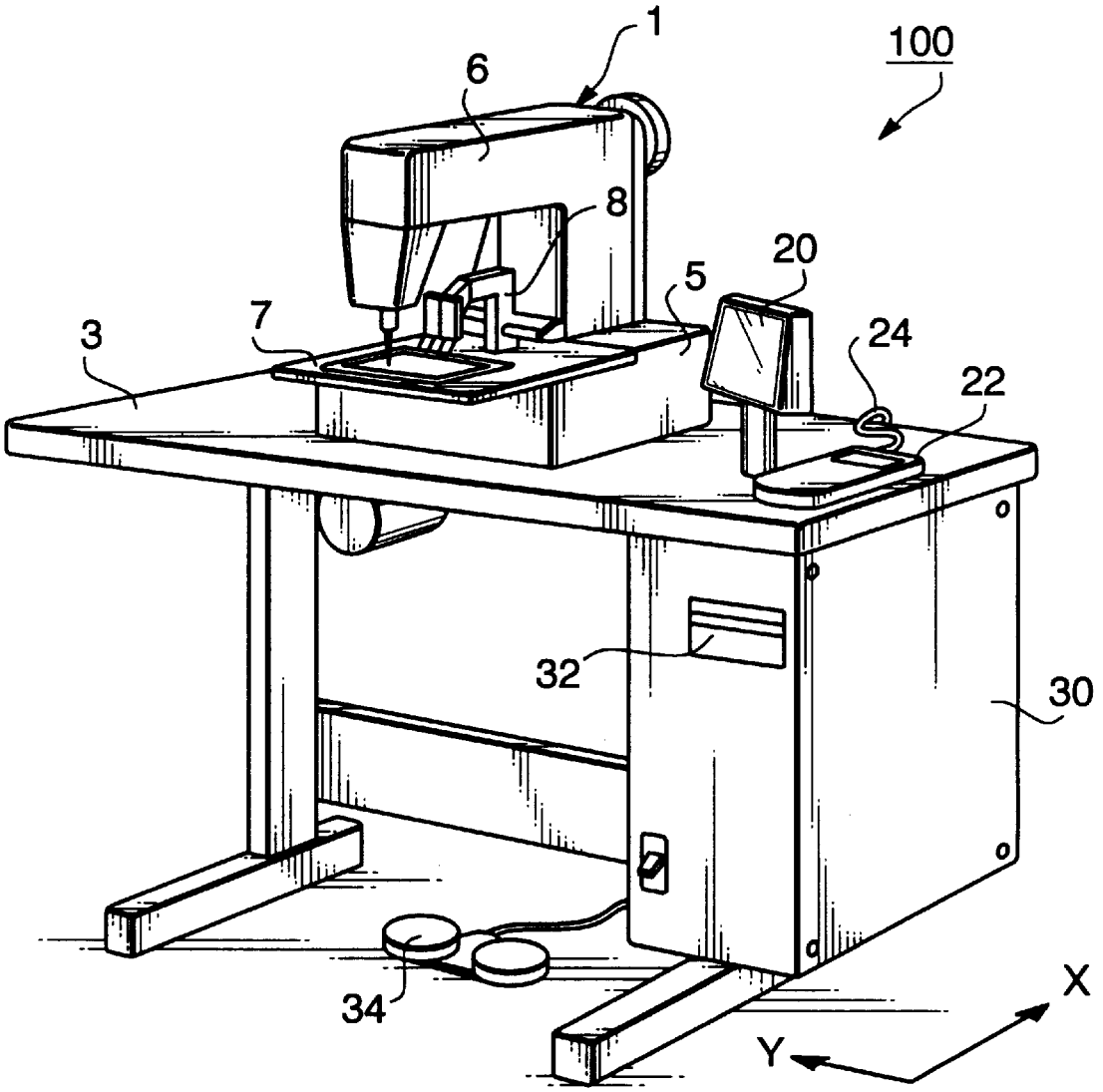
FIG. 1 is a perspective view of an electronically controlled sewing machine system according to an embodiment of the invention.

FIG. 1 is a perspective view of a sewing machine system 100 according to an embodiment of the invention. The sewing machine system 100 includes an electronically controlled sewing machine 1 which is mounted on a sewing desk 3. The sewing machine 1 has a machine bed 5, and on the machine bed 5, an arm unit 6 is mounted. On the upper front surface of the machine bed 5, an work table 7 is fixedly secured, and on the work table 7, a cloth holding device 8 is provided. The cloth holding device 8 holds and moves a working cloth to be sewn in a horizontal direction, i.e., in X and Y directions which are indicated in FIG. 1.

Figure 2:
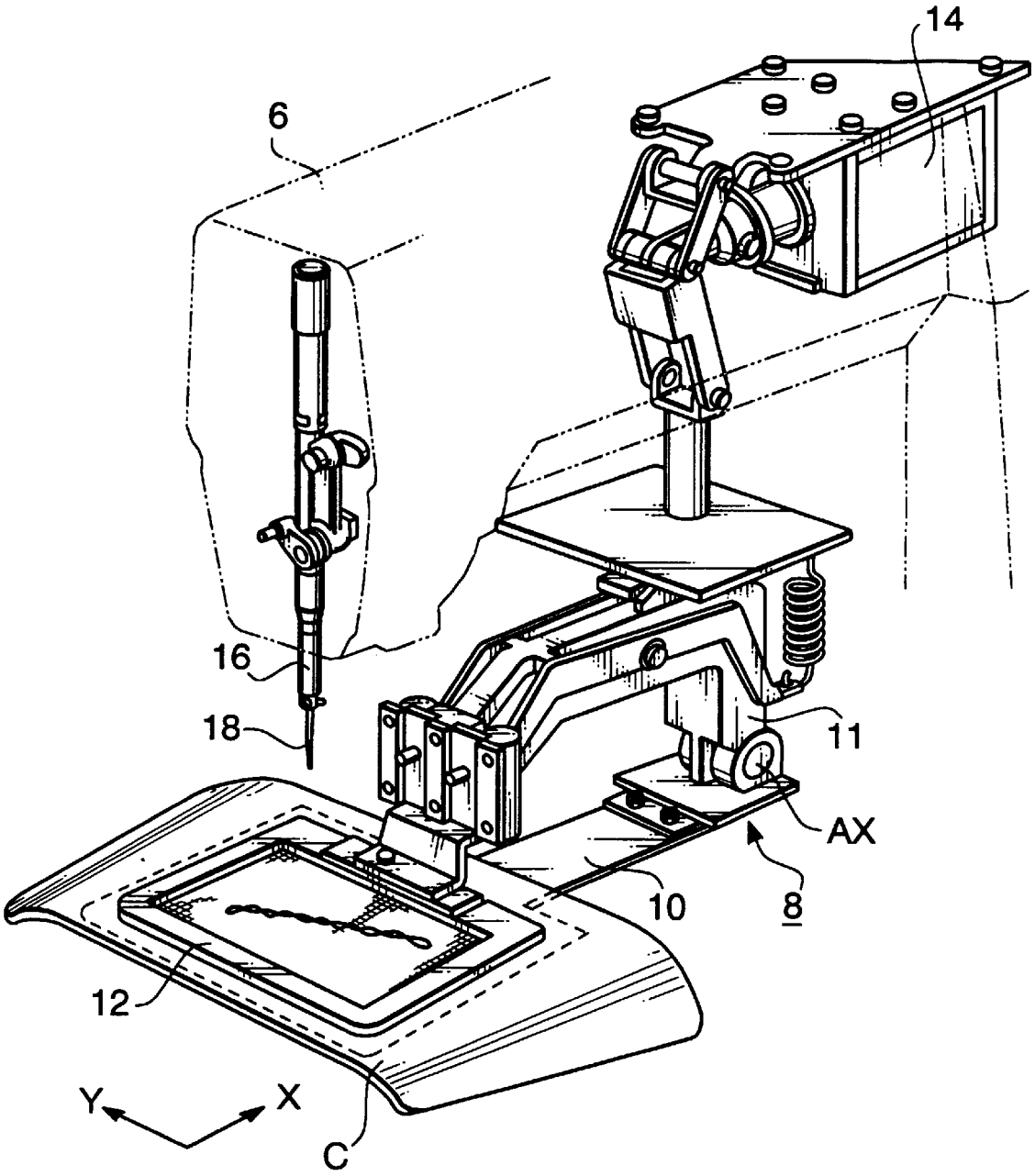
FIG. 2 is an enlarged perspective view of the sewing machine.

FIG. 2 is an enlarged perspective view of the arm unit 6 and the cloth holding device 8. The cloth holding device 8 includes a movable plate 10 which is movable in the X and Y directions, an arm 11 secured on an upper surface of the movable plate 10, a cloth holding plate 12 which is provided at a front end portion of the arm 11. The cloth holding plate 12 is, together with the arm 11, rockable about an axis AX so as to be movable between a cloth holding position as shown in FIG. 2 and a retracted position at which the cloth holding plate 12 is apart from the movable plate 10. Specifically, the cloth holding plate 12 is neutrally urged to be located at the retracted position due to urging force of a spring (not shown). When a solenoid 14 provided in the arm 6 is energized, the cloth holding plate 12 is moved toward and urged against the movable plate 10 so that a working cloth can be firmly held therebetween.

At a front end portion of the arm 6, a needle rod 16 which reciprocates in up-and-down direction is provided, and at a lower end of the needle rod 16, a sewing needle 18 is secured.

Further, as shown in FIG. 1, an operation unit 20 and a programmer 22 are provided on the working desk 3. The operation unit 20 is operated by a user when sewing operation is to be performed. While, the programmer 22 is operated when sewing data is to be processed (e.g., edited, deleted or the like). The programmer 22 is connected to the sewing machine 1 by means of a cable 24, and can be detached from the sewing machine 1. It should be noted that, the programmer 22 can be used for another sewing machine system, i.e., can be connected to another sewing machine with use of the capable 24.

Figure 3:
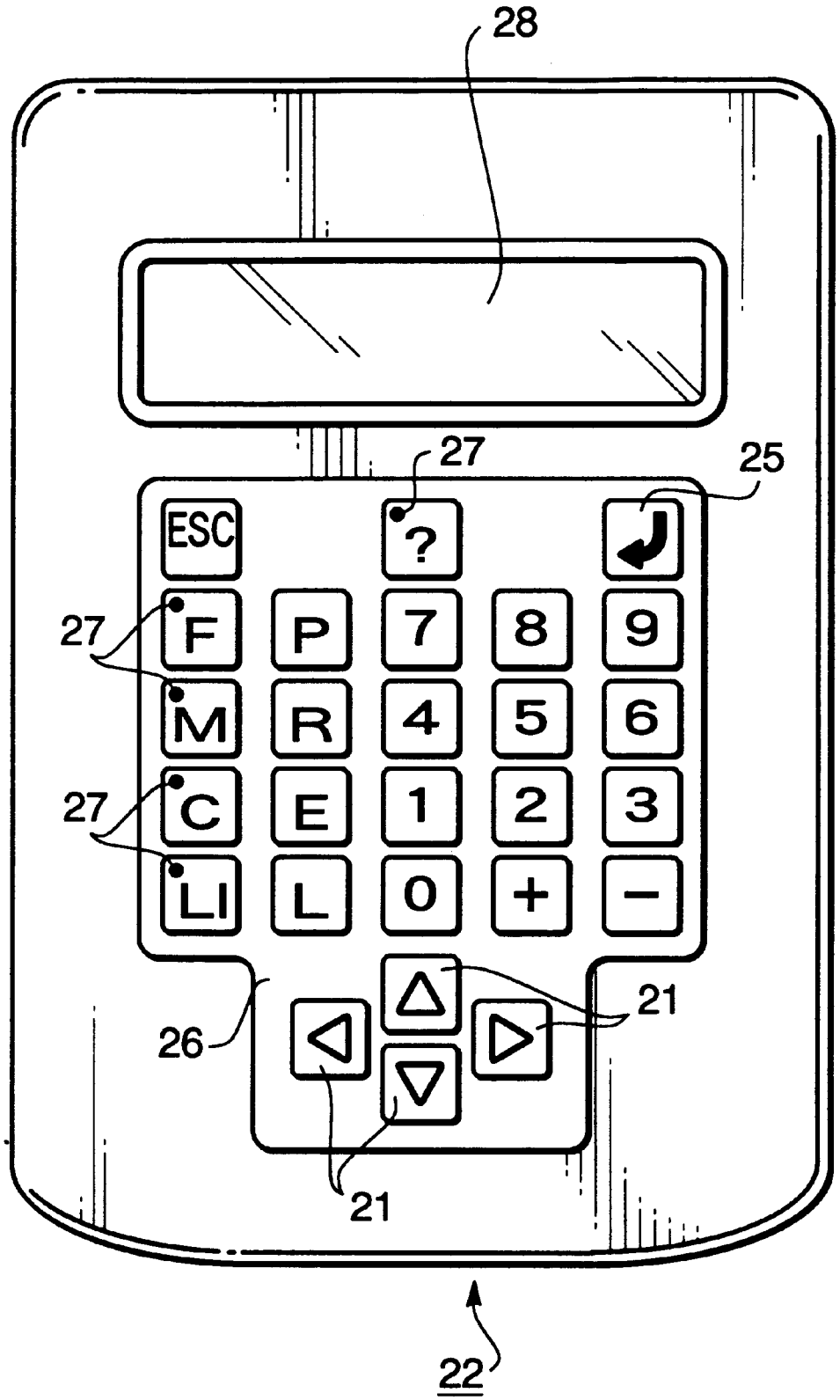
FIG. 3 is a front view of a programmer equipped in the sewing machine system shown in FIG. 1.

FIG. 3 shows a front view of the programmer 22. The programmer 22 has an operation panel 26 provided with a plurality of keys for inputting various commands, data to edit sewing data. An enter key 25, cursor move keys 21 are also provided on the operation panel 26. On each of "?", "F", "M", "C", "LI" keys, an LED 27 is provided. The LED 27 is lit when the key on which the LED is provide is operable. Further, the programmer 22 has a dot matrix type LCD (Liquid Crystal Device) 28 having a 248×60 dot display screen. In the sewing machine system 100, a flexible disk (not shown) is used as a data recording medium. As shown in FIG. 1, on one side below the working table 3, a casing 30 accommodating a control system of the sewing machine 1 is provided. The casing 30 also includes a flexible disk drive 32. Into the flexible disk drive 32, the flexible disk (not shown) is to be inserted. Sewing programs (data files) to be read and/or to be edited by the operator are stored in the flexible disk. Further, below the working table 3, on the floor, a pedal switch 34 for starting/stopping sewing operation, up/down movement of the cloth holding plate 12 is provided.

Figure 4:
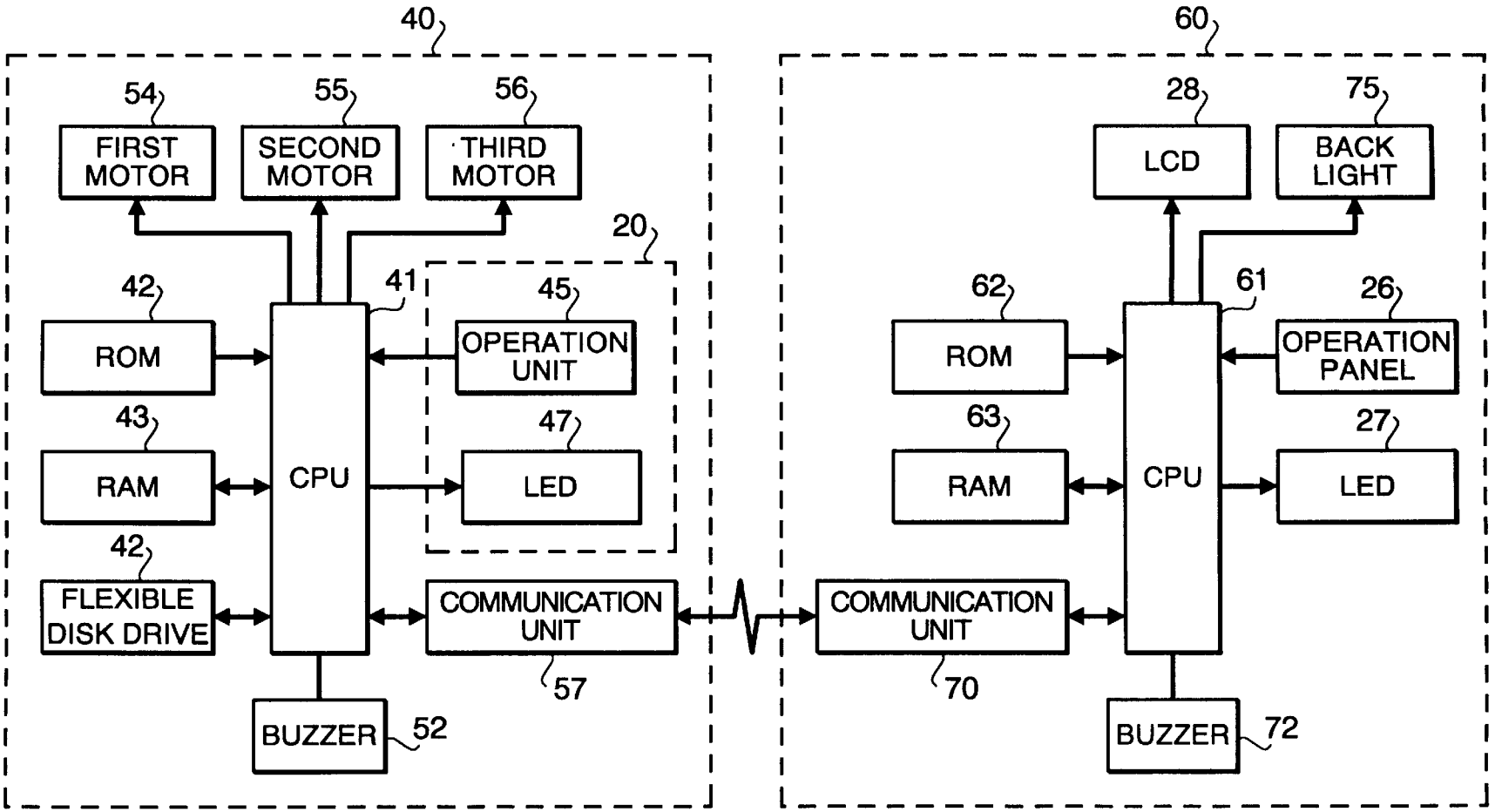
FIG. 4 is a block diagram of the sewing machine system shown in FIG. 1.

FIG. 4 is a block diagram showing the control systems of the sewing machine system 100. As shown in FIG. 4, the sewing machine system 100 include two control systems: a control system 40 of the sewing machine 1; and a control system 60 of the programmer 22. The control systems 40 and 60 are capable of exchanging data through the cable 24.

The control system 40 includes a CPU 41, a ROM 42, a RAM 43, an operation panel 45, LED's 47, a communication unit 50, a buzzer 52, a first motor 54, a second motor 55, a third motor 56, the flexible disk drive 32 and the like.

The CPU 41 controls the entire operation of the sewing machine 1. In the ROM 42, various programs to be executed by the CPU 41 are stored. The RAM 43 has a program storing area for temporarily storing a sewing program. When the automatic sewing operation is performed, the CPU 41 controls the operation of the sewing machine 1 in accordance with the sewing program stored in the program storing area of the RAM 43.

The operation panel 45 is provided with a plurality of keys (not shown), and provided on operation unit 20. The LED's 47 are for indicating operation conditions, and for warning. The LED's 47 are also provided on the operation unit 20. The buzzer 52 is provided for indicating an error condition or the like by sound. The first motor 54 and the second motor 55 respectively drive the cloth holding device 8 in X and Y directions. The third motor 56 drives a sewing mechanism including the needle rod 16, a loop taker mechanism (not shown) and the like.

The control system 60 includes a CPU 61, a ROM 62, a RAM 63, the operation panel 26, the LED's 27, the communication unit 70, a buzzer 72, the LCD 28, and a back light 75.

The CPU 61 controls the entire operation of the programmer 22. The ROM 62 stores various programs to be executed by the CPU 61. The RAM 63 temporarily stores data when the CPU 61 operates. The RAM 63 also has a program storing area for temporarily storing a sewing program. It should be noted that the program stored in the RAM 63 is not referred to when the sewing machine 1 performs the automatic sewing operations.

The CPU 61 is capable of receiving a sewing program transmitted from the control system 40 via the communication unit 70, and storing the received sewing program in the RAM 63. Further, the CPU 61 is capable reading a sewing program created or modified and stored in the RAM 63, and transmitting the same to the control system 40 via the communication unit 70.

It should be noted that power is always supplied to the RAM 63. Accordingly, even when a power switch (not shown) of the programmer 22 is turned OFF, data (i.e., the sewing program) stored in the RAM 63 will not be lost.

The buzzer 72 is for indicating an error condition of the programmer 22 by sound. The back light 75 is used for illuminating the LCD 28 from behind to improve contrast of the displayed image.

The communication units 50 and 70 are interfaces for allowing serial data transmission via the cable 24.

Although not shown in the drawings, the ROM 42, the RAM 43, the communication unit 50 are connected to the CPU 41 through a bus. While, the operation panel 45, the LED's 47, the buzzer 52, the X-axis motor 54, the Y-axis motor 55, the sewing machine motor 56, the flexible disk drive 57 are connected to respective interface circuits, which are connected to the CPU 41 through the bus.

Similarly, the ROM 62, the RAM 63, the communication unit 70 are connected to the CPU 61 through a bus. While, the operation panel 26, the LED's 27, the buzzer 72, the LCD 28, the back light 75 are connected to respective interface circuits, which are connected to the CPU 61 through the bus.

Hereafter, a file access procedure according to a first embodiment will be described with reference to FIGS. 5–7.

Figure 5:
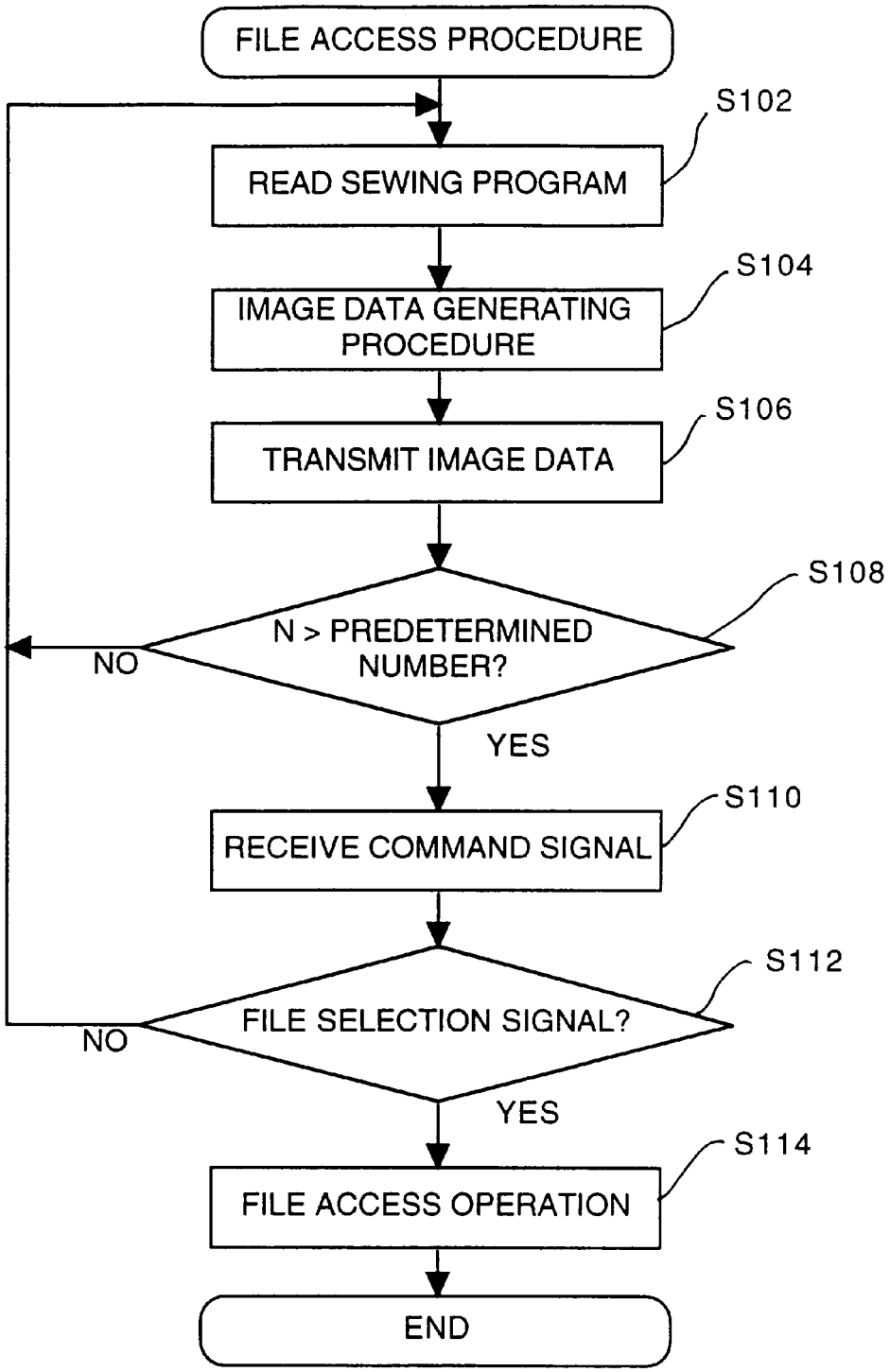
FIG. 5 shows a flowchart illustrating a file access procedure executed by a controller of a sewing machine.
Figure 6:
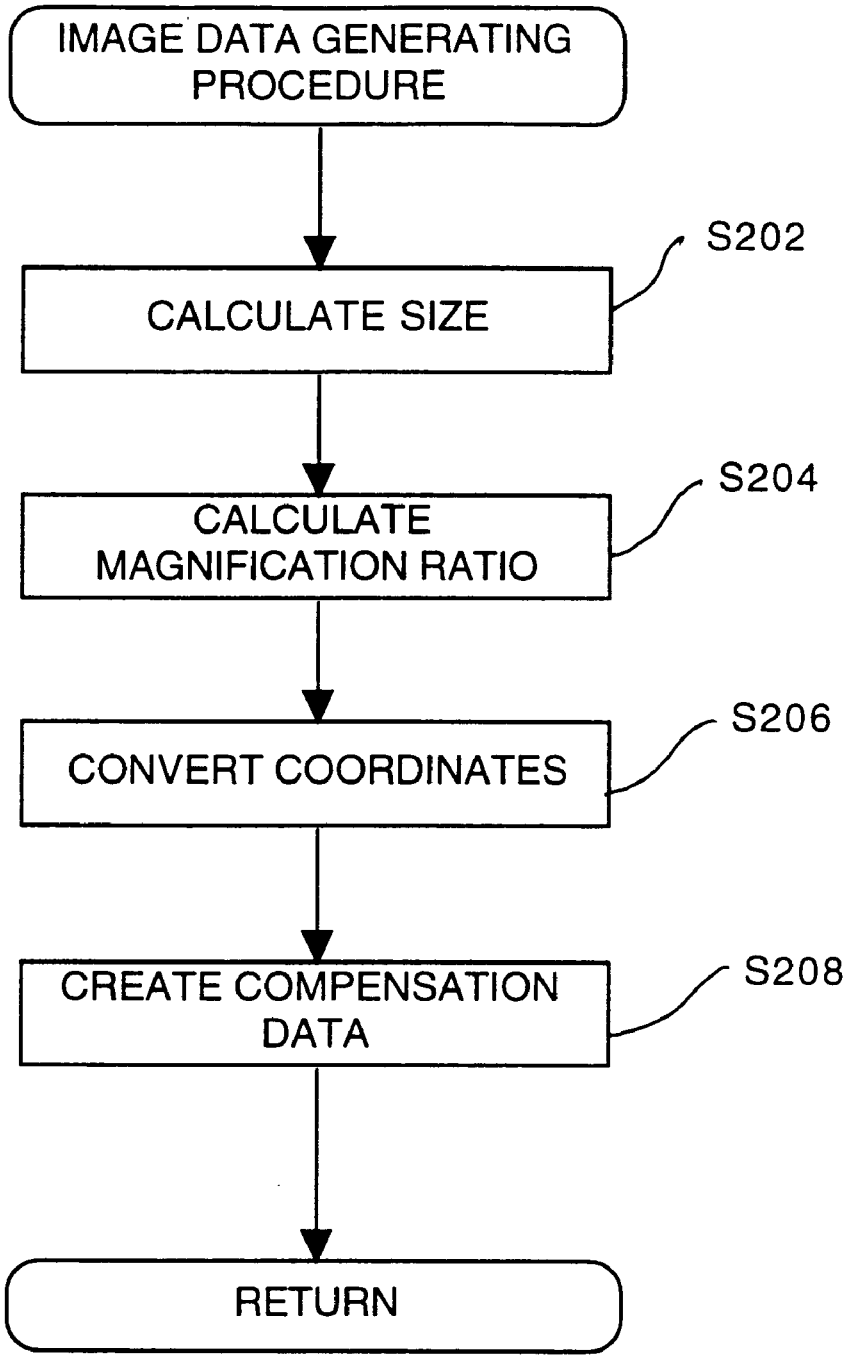
FIG. 6 shows a flowchart illustrating an image data creating procedure which is a sub-routine called in the file access procedure shown in FIG. 5.

FIG. 5 shows a flowchart illustrating a file access procedure executed by the control system 40 of the sewing machine 1, and FIG. 6 shows a flowchart illustrating an image data generating procedure which is a sub-routine called in the file access procedure shown in FIG. 5.

The file access procedure shown in FIG. 5 is initiated in response to a predetermined operation of the operation panel 26 of the programmer 22. When the operator operates keys of the operation panel 26, a command corresponding to the operated keys is transmitted from the programmer 22 to the control system 40 of the sewing machine 1 through the cable 24. If the transmitted command is for initiating the file access procedure, the CPU 41 starts the file access procedure shown in FIG. 5. Substantially at the same time, the CPU 61 of the programmer 22 also initiates a file access procedure shown in FIG. 7.

The file access procedure is a procedure including operations of reading a sewing program from the flexible disk, deleting a program file, overwriting a program file and the like. Depending on the operation of the keys of the programmer 22, one of the above operations is selected and initiated.

When the CPU 41 starts the file access procedure shown in FIG. 5, the CPU 41 reads one of the program files stored in the flexible disk accommodated in a disk cartridge which is inserted in the flexible disk drive 32 (S102), and executes the image data generating procedure (S104) which is illustrated in FIG. 6.

Figure 8A:
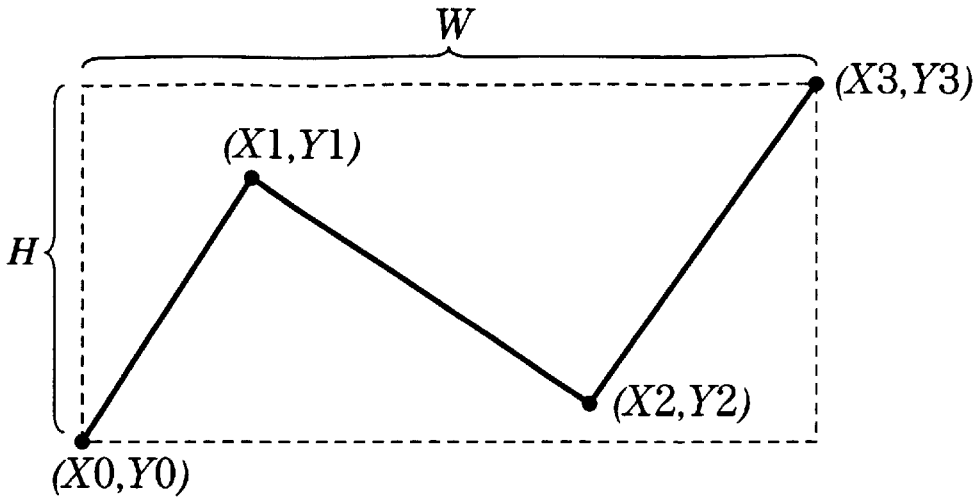
FIG. 8A shows a relationship between coordinate data and a pattern sewn based on the coordinate data.

In the image data generating procedure shown in FIG. 6, the CPU 41 determines a size of a pattern which would be sewn if the sewing machine 1 performs sewing operation in accordance with the sewing program (S202). For example, if the sewing program is for sewing a pattern shown in FIG. 8A, the sewing program contains coordinate data (X0, Y0) through (X3, Y3) of stitching points. In this embodiment, the minimum unit of the coordinate data is 0.1 mm. The CPU 41 compares each value of coordinate data and determines the minimum and maximum values for each of X-axis and Y-axis. Then, the CPU 41 subtracts the minimum values from the maximum values to determine a height H and a width W of the pattern (the height corresponding to the Y-axis, and the width corresponding to the X-axis).

Then, the CPU 41 calculates, at S204, a magnification ratio Z which is the smaller of w/W and h/H, where w is a width of a screen of the LCD 28 and h is a height of the screen of the LCD 28.

At S206, all the coordinate data values (X0, Y0)–(X3, Y3) are multiplied by the ratio Z to convert the same to converted coordinate data (x0, y0)–(x3, y3). Then, at S208, the CPU 41 applies interpolations with respect to the coordinates (x0, y0)–(x3, y3) by connecting the coordinates with lines, and generates the image data thereof.

Specifically, the CPU 41 firstly determines a formula expressing a line connecting two adjoining coordinates (xi, yi) and (xj, yj). Then, the CPU 41 changes the value of x from xi to xj by one and determines values of y based on thus obtained formula. During this calculation, the calculated values y are rounded to become integer, and sets points corresponding to the calculated coordinates of a data area of the RAM 43, which is a bit map area, to ON. If the value of y changes more than 2 when x is changed by one, values of x is determined by changing the value of y by one. In this case, the value of x is rounded to become an integer. By executing the above-described process for all the coordinate data (x0, y0)–(x1, y1), the intermediate points of the coordinates are linearly interpolated.

Figure 8B:
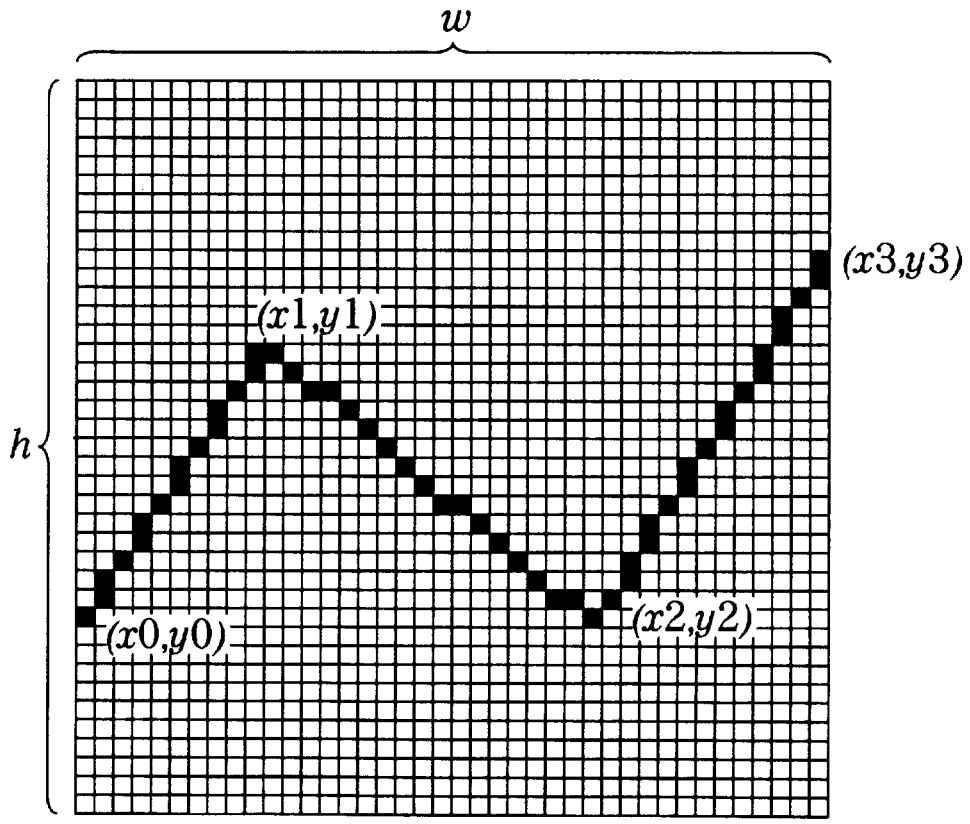
FIG. 8B shows a relationship between the coordinate data and a pattern image displayed on a displaying device.

After the processes of S202–S208 have been finished, in the data area of the RAM 43, a bit map indicative of the sewing pattern of which magnification is adjusted to fit the screen of the LCD 28 is generated as shown in FIG. 8B.

It should be noted that, at S204, the magnification ratio is determined in accordance with the width W and height H of the pattern and the width w and height h of the screen of the LCD 28. Accordingly, the pattern is displayed as large as possible on the screen of the LCD 28, and the operator can view a relatively detailed image of the pattern.

It may be possible to determine the magnification ratio in accordance with a width W2 and a height H2 of an area of the working cloth within which the sewing pattern is formed instead of the width W and height H of the pattern itself. In such a case, a positional relationship of the pattern with respect to the sewing area can be recognized. Therefore, either the width W and height H of the pattern or the width W2 and height H2 of the sewing area may be selected in accordance with a function required. It may be advantageous if a switch is available for the operator to switch the above-described two types of display modes.

When the image data generating procedure (S104) has been finished, the image data stored in the RAM 43 is transmitted to the programmer 22 (S106).

It should be noted that when the communication unit 50 is receiving a busy signal, data transmission is paused (i.e., the data is not transmitted), and when no busy signal is received, the image data stored in the RAM 43 is transmitted from the communication unit 50 to the programmer 22 (i.e., the communication unit 70).

Figure 9:
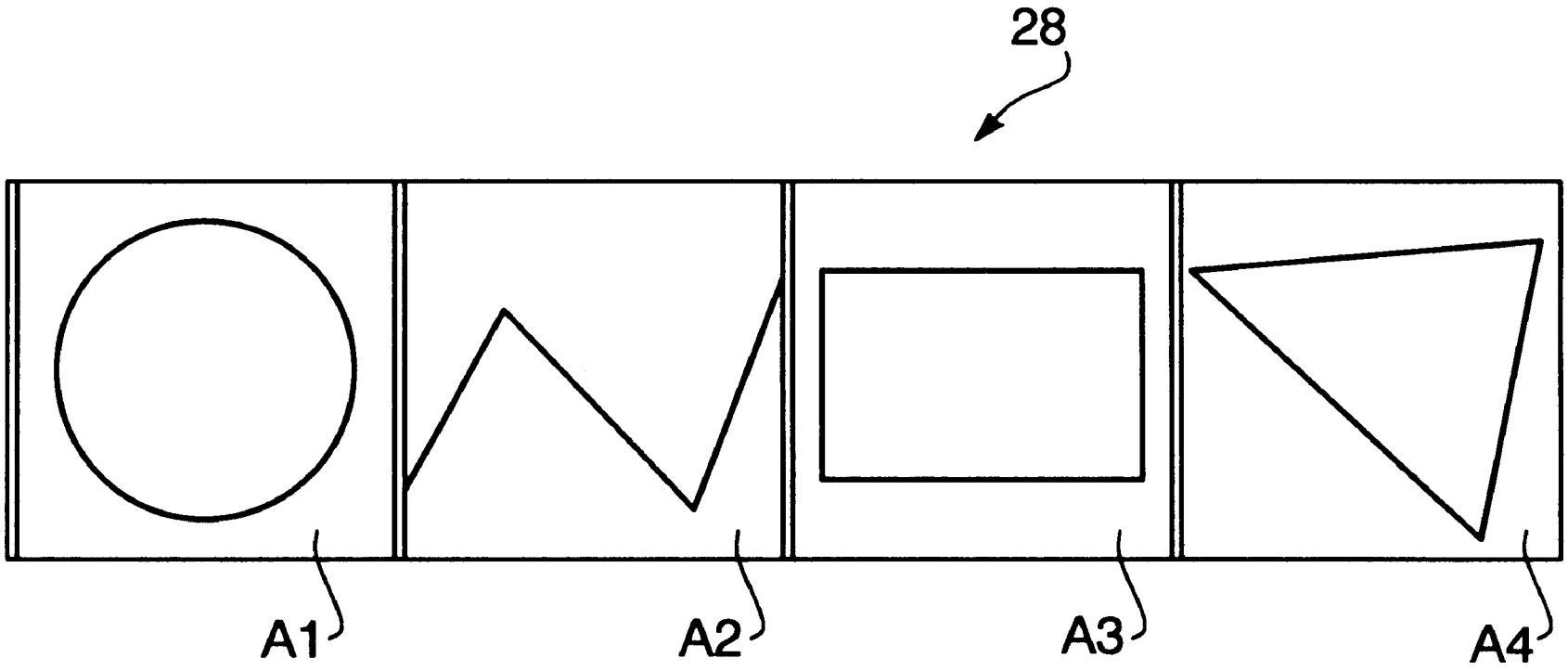
FIG. 9 shows a screen image of the displaying device on which a plurality of patterns are displayed.

In S108, it is determined whether the number N of patterns whose image data have been transmitted becomes equal to or greater than a predetermined number. In other words, it is determined whether image data corresponding to a predetermined number of patterns has been transmitted. If there remains image data to be transmitted (S108:NO), control returns to S102 and above described process is repeated. In this embodiment, as shown in FIG. 9, the screen of the LCD 28 has four image displaying area A1–A4 for displaying images of four sewing patterns simultaneously. Thus, in S108, if image data corresponding to the four patterns have not yet been transmitted, control returns to S102, while if image data corresponding to the four patterns have been transmitted, control proceeds to S110.

In S110, the CPU 41 waits for receiving a predetermined command signal from the programmer 22. Specifically, until the CPU 41 is ready to receive a signal, the communication unit 50 keeps transmitting a busy signal. When the CPU 41 is ready to receive the signal, the communication unit 50 stops transmitting the busy signal. In response to termination of the busy signal, the programmer 22 starts transmitting a signal. When the CPU 41 has received the data, the communication unit 50 starts transmitting the busy signal again. Thereafter, until the communication unit 50 stops transmitting the busy signal, the communication unit 50 does no receive data from the programmer 22.

When the CPU 41 has received a command through the communication unit 50, it is examined, at S112, whether the received command is a file selection signal indicating that a certain data file is selected. If the received command is not the file selection signal (S112:NO), the received command is a command requesting display of next candidates. In this case (S112:NO), control returns to S102, and image data for another four patterns will be generated and transmitted to the programmer 22. If the received command is the file selection signal (S112:YES), then the file access operation is executed with respect to a currently selected file (S114) and the file access procedure is terminated.

Figure 7:
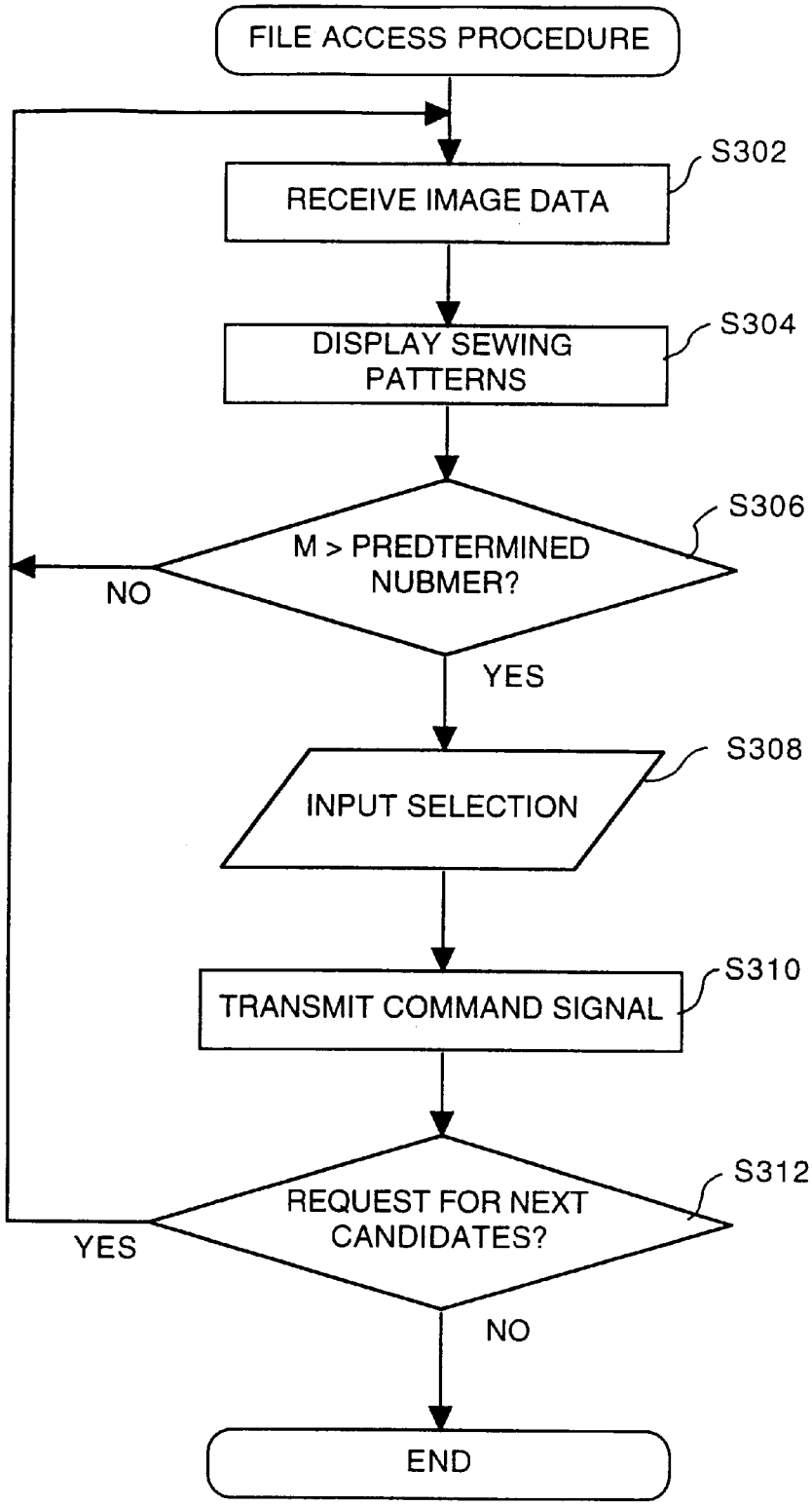
FIG. 7 shows a flowchart illustrating a file access procedure executed by a controller of a programmer.

Simultaneously with the above-described file access procedure of the CPU 41, the CPU 61 performs the file access procedure shown in FIG. 7. The CPU 61 waits for reception of the image data in S302. It should be noted that the communication unit 70 keeps transmitting a busy signal until it is not ready to receive a signal, and stop outputting the busy signal when it is ready to receive a signal. Further, when the CPU 61 has received a signal required, the communication unit 70 starts transmitting the busy signal again.

When the CPU 61 has received the image data, the CPU 61 stores the data in the RAM 63 and then controls the LCD 28 to display an image of the pattern in accordance with the received image data within one of the four display areas A1–A4 shown in FIG. 9 (S304). In this embodiment, each of the display areas A1–A4 has 60×60 dots area.

In S306, the CPU 61 checks whether it has received image data corresponding to the predetermined number M of sewing patterns. In this embodiment, the predetermined number is four. If the CPU 61 has not yet received the image data corresponding to four sewing patterns (S306:NO), control returns to S302 to receive subsequently transmitted image data. If the image data corresponding to the predetermined number M of sewing patterns have been received (S306:YES), the CPU 61 waits for selection by the operator (S308).

The operator can select one of the patterns displayed on the screen of the LCD 28 by operating the cursor moving keys 21, or alternatively, send a command requesting for display of next four patterns. When the operator operate a key, a command corresponding to the operated key is transmitted to the sewing machine (S310). It should be noted that when the command is transmitted in S310, the communication unit 70 remains in stand-by state while it receives the busy signal, and when the busy signal stops, the communication unit 70 transmits the command to the sewing machine 1. If the transmitted command is to request the image data corresponding to the next four sewing patterns (S312:YES), control returns to S302, and the above-described operation is repeated. If one of the patterns displayed in the display areas A1–A4 has been selected and the file selection signal has been transmitted (S312:NO), the file access procedure shown in FIG. 7 is terminated.

An example of the file access operation is described hereinafter. When the operator selects a pattern displayed on the screen of the LCD 28 using the cursor movement keys 21 to highlight one of the displayed patterns, and then depresses the enter key 25, the file selection signal is transmitted to the communication unit 50. Then, the CPU 41 of the sewing machine reads the program file which is indicated by the file selection signal from the flexible disk, stores the same in the RAM 43. The program file is transmitted from the communication unit 50 to the communication unit 70, and then stored in the RAM 63 of the programmer 22. Thereafter, the operator is capable of modify the program file stored in the RAM 63 with use of the keys provided on the operation panel 26 to create a new program data. The new program data created by modifying the program data stored in the RAM 63 can be sent from the communication unit 70 to the communication unit 50 and then stored in the RAM 43. Further, the program data stored in the RAM 43 can be stored in a flexible disk which is inserted in the flexible disk drive 32.

Figure 10:
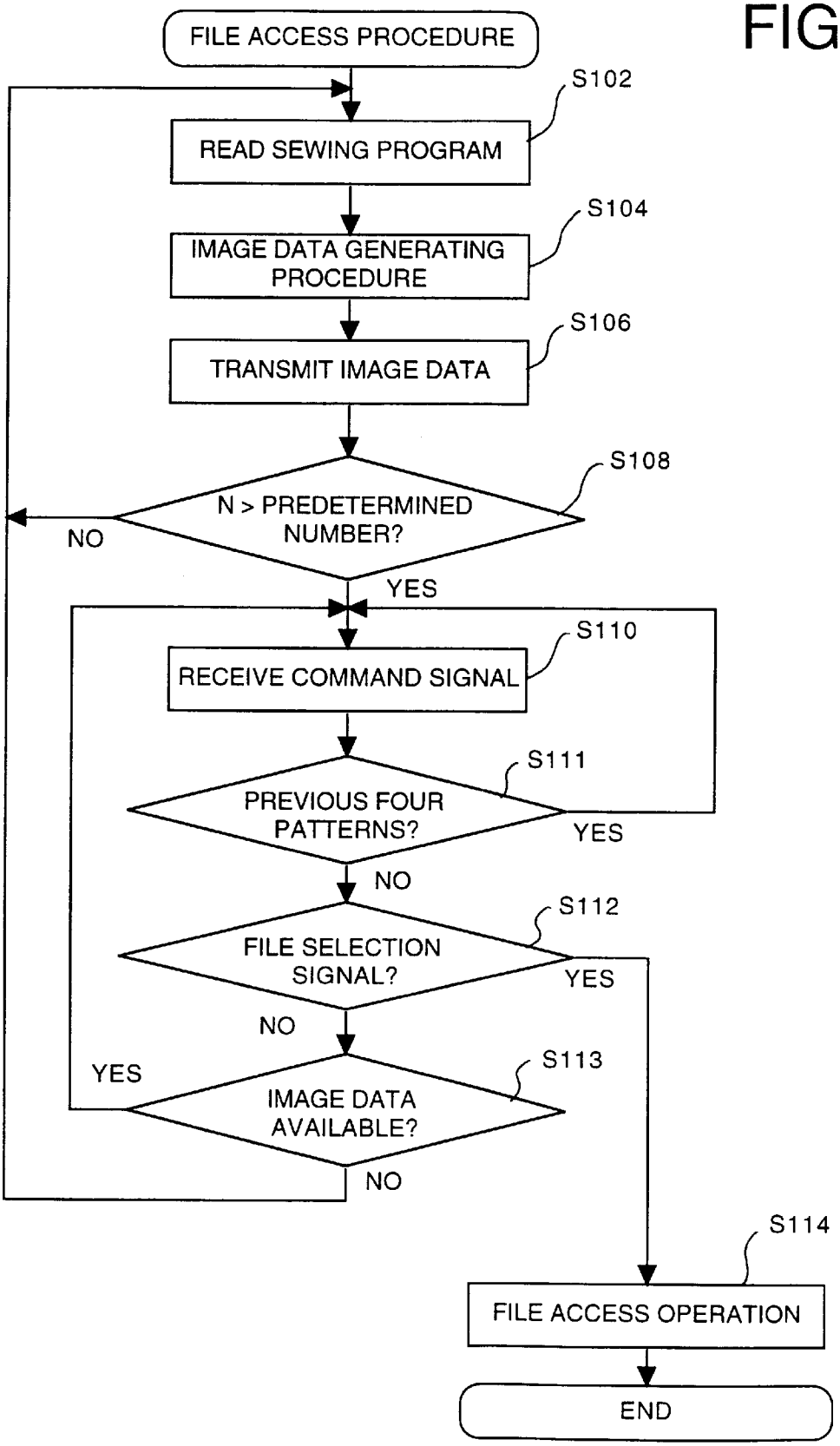
FIG. 10 shows a flowchart illustrating a modified file access procedure executed by a controller of a sewing machine.
Figure 11:
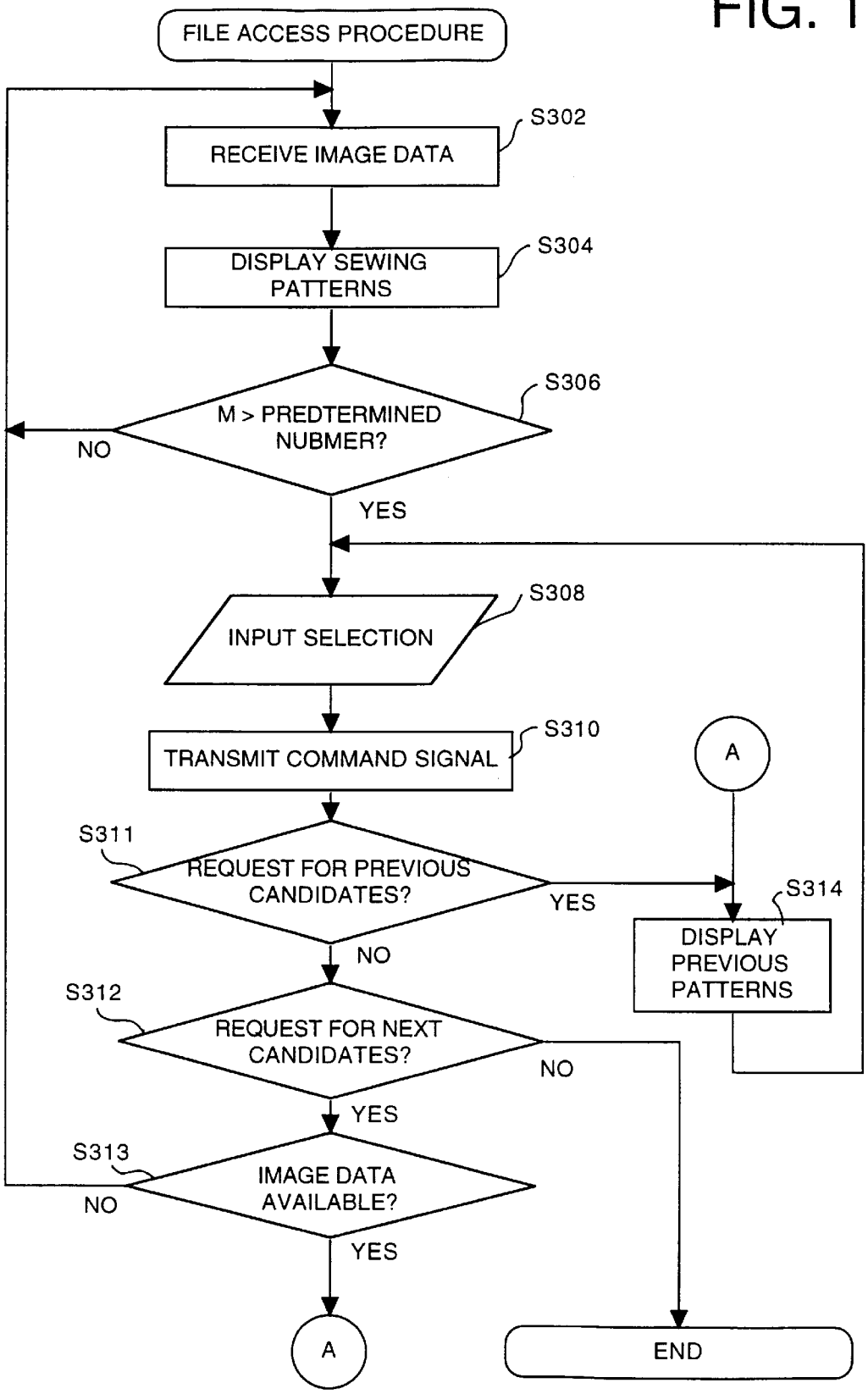
FIG. 11 shows a flowchart illustrating a modified file access procedure executed by a controller of a programmer.

FIGS. 10 and 11 show flowcharts illustrating modified file access procedures according to a second embodiment of the invention.

According to the second embodiment, all the image data transmitted from the control system 40 is stored in the RAM 63. When the first four patterns are displayed, and the next four patterns are displayed, the image data for the first four patterns are stored in the RAM 63. Thereafter, the operator is allowed to request for display of previous four patterns. In such a case, the CPU 61 examines whether the image data corresponding to the previous four patterns is available (i.e., stored in the RAM 63), and if the image data is available, the CPU 61 utilizes the stored data. Accordingly, in this case, it is not necessary that the image data is generated and transmitted from the sewing machine 1.

FIG. 10 is similar to FIG. 5 except that steps S111, S113 are inserted. After the CPU 41 receives the command signal in S110, if the received command is a command requiring a previous four patterns (S111:YES), control proceeds to S110. That is, the CPU 41 does nothing but waits for reception of another command signal. It is because, when the previous four patterns are to be displayed, the image data therefor has already been generated and transmitted to the control system 60, and stored in the RAM 63. Therefore, it is not necessary to resend the image data.

If the received command is not a file selection signal (S112:NO), it is a command requesting next four patterns. In this case, it is necessary to determine whether the image data has already been transmitted to the control system 60 or not in S113. If the image data has already been generated and transmitted, i.e., the image data has been stored in the RAM 63 (S113:YES), control proceeds to S110, and no image data will be transmitted to the control system 60. Otherwise, control proceeds to S102, and image data for next four patterns will be generated, and transmitted to the control system 60.

FIG. 11 is similar to FIG. 7 except that steps S311, S313 and S314 are added. If the operator requests the previous four patterns (S311:YES), since the image data has been stored in the RAM 63, control proceeds to S314 and display the previous four patterns in accordance with the image data stored in the RAM 63. If the operator request the next four patterns, it is determined in S313 whether the image data for the next four patterns has been stored in the RAM 63. If the image data is stored in the RAM 63 (S313:YES), the next four patterns are displayed (S314). If the image data has not been stored in the RAM 63, control proceeds to S302, and the image data generated by the control system 40 is received.

When the operator selects one of the patterns displayed on the screen of the LCD 28, the identifier corresponding to the displayed pattern is transmitted to the control system 40 as the file selection signal. The control system 40 read, in response to reception of the file selection signal, the program file corresponding to the file selection signal, or the identifier and transmits the sewing program to the control system 60.

According to the second embodiment, since the image data which has once transmitted from the control system 40 is stored in the RAM 63 and referred to when the it is necessary, processing speed is made faster for display of the pattern which have previously been displayed.

The present disclosure relates to subject matter contained in Japanese Patent Application No. HEI 04-136878, filed on May 27, 1997, which is expressly incorporated herein by reference in its entirety.

What is claimed is:

1. An electronically controlled sewing machine capable of creating a sewing program including a programmer for creating said sewing program defining a sewing pattern, and a data recording medium, said sewing program being stored in said data recording medium, said electronically controlled sewing machine performing an automatic sewing operation in accordance with said sewing program, said sewing machine comprising:

a reading device that reads a plurality of sewing programs stored in said data recording medium;

an image data generating device that generates image data indicative of sewing patterns respectively corresponding to said plurality of sewing programs read by said reading device;

a displaying device that displays a graphic depiction of each of said plurality of sewing patterns in accordance with said image data;

a selecting device that is manually operated to select one of the sewing patterns displayed on said displaying device; and a sewing program processing device that processes a sewing program corresponding to the selected sewing pattern and controls said reading device to read said sewing program corresponding to said selected sewing pattern;

said sewing program processing device having means to delete the sewing program corresponding to said selected sewing pattern, and said sewing program processing device comprising a data editing device for editing said sewing program to create a new sewing program and a data storing device for storing said new sewing program in said data recording medium.

2. The sewing machine according to claim 1, wherein said displaying device comprises an image display screen having a plurality of image display areas, and wherein said image generating device generates said image data such that an entire image of each of said plurality of sewing patterns is displayed in said plurality of image display areas.

3. The sewing machine according to claim 1, wherein said image data generating device determines a magnification ratio of each of the images of said plurality of sewing patterns to each of the image display areas such that the images of plurality of sewing patterns become greatest in said plurality of display areas, respectively.

4. The sewing machine according to claim 1, wherein said displaying device comprises an image display screen having a plurality of image display areas, and wherein said image generating device generates said image data such that entire areas of a plurality of portions on which said plurality of sewing patterns would be sewn when said sewing machine system performs an automatic sewing operation in accordance with said plurality of sewing programs are displayed, respectively.

5. The sewing machine according to claim 4, wherein said image data generating device determines a magnification ratio of each of the images of said plurality of sewing patterns to each of the image display areas such that the areas of said plurality of sewing patterns become greatest in said plurality of display areas, respectively.

6. A sewing machine capable of performing an automatic sewing operation in accordance with a sewing program defining a sewing pattern to form said sewing pattern within a predetermined sewing area on a cloth, said sewing machine being capable of creating said sewing program, said sewing machine comprising:

a displaying device that displays a graphic depiction of the sewing pattern in accordance with said sewing program; and a data editing device which is used to edit the sewing program corresponding to the sewing pattern displayed on said displaying device;

wherein said displaying device has a display area having a predetermined size, and wherein said displaying device includes a display controller which automatically adjusts a size of said sewing pattern displayed on said display area, based on said sewing program, such that an entire area of said sewing pattern is displayed within said display area and such that said sewing pattern has the largest size that fits within said display area.

7. The sewing machine according to claim 6, wherein said displaying device has a plurality of display areas each having a predetermined size, a plurality of sewing patterns being displayed in respective display areas, and wherein said display controller automatically adjusts a size of said plurality of sewing patterns displayed in said display areas, based on said sewing programs, such that an entire area of said sewing patterns are displayed within said display areas, respectively.

8. The sewing machine system according to claim 7, further comprising:

a first selector that is manually operable to select one of said plurality of sewing patterns respectively displayed in said plurality of display areas; and a second selector that is manually operated to select whether a sewing program corresponding to a sewing pattern selected with use of said first selector is to be edited by said data editing device.

9. A sewing machine system capable of creating a sewing program to be used for automatic sewing operation, comprising:

an electronically controlled sewing machine, which includes:

a sewing program processing device that reads sewing programs stored in a data recording medium;

an image data generating device that generates image data indicative of a sewing pattern corresponding to a sewing program read by said sewing program processing device; and a first communication device that transmits said image data;

a data editing device, which includes:

a second communication device that receives said image data transmitted from said first communication device;

a displaying device that displays said sewing pattern in accordance with said image data received by said second communication device; and a selector that is manually operated to select said sewing pattern displayed on said displayed device, wherein said second communication device transmits data related to a selected sewing pattern to said first communication device upon one of said sewing patterns has been selected, and wherein said sewing program processing device applies a predetermined operation to the sewing program corresponding to said selected sewing pattern and stored in said data recording medium.

10. The sewing machine system according to claim 9, wherein said predetermined operation includes deletion of said sewing program corresponding to said selected sewing pattern from said data recording medium.

11. The sewing machine system according to claim 9, wherein said sewing program processing device reads, in accordance with said data related to said selected sewing pattern received by said first communication device, a sewing program corresponding to said selected sewing pattern, and wherein said first communication device transmits the sewing program corresponding to said selected sewing pattern and read by said sewing program processing device to said second communication device, said sewing program being edited by said data editing device.

12. The sewing machine system according to claim 11, wherein said sewing program edited by said data editing device is transmitted by said second communication device, received by said first communication device, and stored in said data recording medium by said sewing program processing device.

13. The sewing machine system according to claim 9, wherein said data editing device is detachablly connected to said electronically controlled sewing machine.

14. The sewing machine system according to claim 13, further comprising an operating device that is manually operated when a sewing operation is to be performed, said operating device being provided separately from said data editing device.

15. A method of processing program files for a sewing machine capable of creating a sewing program which is used for an automatic sewing operation, comprising:

reading a plurality of sewing programs stored in a data recording medium;

generating image data indicative of a sewing pattern corresponding to each sewing program read in the step of reading;

displaying a graphic depiction of sewing patterns in accordance with the generated image data;

selecting one of the displayed sewing patterns; and applying a predetermined operation to a sewing program corresponding to the selected sewing pattern;

wherein said step of applying a predetermined operation includes the steps of:

deleting the sewing program; and editing the sewing program to create a new sewing program and storing the new sewing program in the data recording medium.

16. A memory for storing a program to be executed by a computer, said program containing a method of processing program files for a sewing machine capable of creating a sewing program which is used for an automatic sewing operation, wherein said method comprises the steps of:

reading a plurality of sewing programs stored in a data recording medium;

generating image data indicative of a sewing pattern corresponding to each sewing program read in the step of reading;

displaying a graphic depiction of a plurality of sewing patterns in accordance with the generated image data;

selecting one of the displayed sewing patterns; and applying a predetermined operation to a sewing program corresponding to the selected sewing pattern;

said step of applying a predetermined operation includes the steps of:

deleting the sewing program; and editing the sewing program to create a new sewing program and storing the new sewing program in the data recording medium.

17. The sewing machine according to claim 6, wherein sewing program edited by the data editing device being stored in a data recording medium, said sewing program stored in the data recorded medium being read therefrom and displayed on said displaying device.

18. A sewing machine capable of performing an automatic sewing operation in accordance with a sewing program defining a sewing pattern to form said sewing pattern within a predetermined sewing area on a cloth, said sewing machine being capable of creating said sewing program, said sewing machine comprising:

a displaying device that displays a graphic depiction of the sewing pattern in accordance with said sewing program; and a data editing device which is used to edit the sewing program corresponding to the sewing pattern displayed on said displaying device;

wherein said displaying device including at least one display area having a predetermined size, the graphic depiction of the sewing pattern being displayed such that said predetermined sewing area on the cloth has the largest size that fits within the display area.

19. The sewing machine according to claim 18, wherein said displaying device includes a plurality of display areas, each of said display areas having a predetermined size, the graphic depiction of the sewing pattern being displayed such that the predetermined sewing area on the cloth has the largest size that fits within the respective display area.

* * * * *